United States Patent [19]

Heggestuen

[11] 4,044,781

[45] Aug. 30, 1977

[54] SMOKING DEVICE

[76] Inventor: James E. Heggestuen, 1017 N. 14th St., Fargo, N. Dak. 58102

[21] Appl. No.: 674,327

[22] Filed: Apr. 7, 1976

[51] Int. Cl.[2] ..... A24F 1/14; A24F 1/26

[52] U.S. Cl. ..... 131/173; 131/180; 131/223

[58] Field of Search ..... 131/173, 180, 198 R, 131/205, 206, 215 R, 215 B, 223, 224

[56] References Cited

U.S. PATENT DOCUMENTS

| | | | |
|---|---|---|---|
| 55,321 | 1/1866 | Masson | 131/173 |
| 1,243,803 | 10/1917 | Bradley | 131/180 |
| 1,505,096 | 8/1924 | Ivory | 131/198 R |
| 3,881,499 | 5/1975 | McFadden et al. | 131/173 |

*Primary Examiner*—Stephen C. Pellegrino
*Attorney, Agent, or Firm*—Merchant, Gould, Smith, Edell, Welter & Schmidt

[57] ABSTRACT

A smoker's accessory comprising a water pipe having an inhalation chamber and a bowl assembly connected thereto and including a hopper for herb to be smoked and a manually operated valve and bowl cavity member for dispensing a measured quantity of herb to the bowl cavity, and displacing the latter between a first, lighting position in which air to the inhalation chamber is drawn from the bowl cavity, and a second position in which air to the inhalation chamber is drawn directly from the atmosphere.

5 Claims, 4 Drawing Figures

SMOKING DEVICE

BACKGROUND OF THE INVENTION

This invention relates to the field of smokers' accessories, and specifically comprises an improved water pipe, in which smoke from smouldering organic material is passed through a liquid before being inhaled. This cools the smoke, removes ash and other particulate constituents, and if the liquid is wine or scented water may add a further taste or odor sensation.

Water pipes in the form of hookahs or narghilas have long been known. They are functional and frequently very ornate, but are large and heavy, and generally consume a relatively large quantity of the herb being smoked at each lighting, of which the smoker actually gets the benefit of only a relatively small portion.

SUMMARY OF THE INVENTION

My invention retains the advantages of cooling and purification characteristic of the water pipe in a structure of modest size which is particularly adapted to consume the smoking material in small measured quantities and retain the smoke in a liquid and inhalation chamber for the user's benefit. A visible element of the pipe, resembling the bowl of an ordinary pipe, is in fact a hopper or canister, and the combustion of the herb does not take place there, but in a relatively small bowl cavity filled from the hopper but lit and consumed out of communication with the hopper. The bowl cavity contains a quantity of the herb only sufficient to supply smoke for the interval of one long puff, at the end of which the ashes pass with the smoke into the liquid in the chamber, the smoke rising to be stored in an inhalation chamber from which it may be drawn in shorter successive inhalations, during which air is supplied to replace the smoke being withdrawn.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DESCRIPTION OF THE PREFERRED EMBODIMENT

Figure 1:
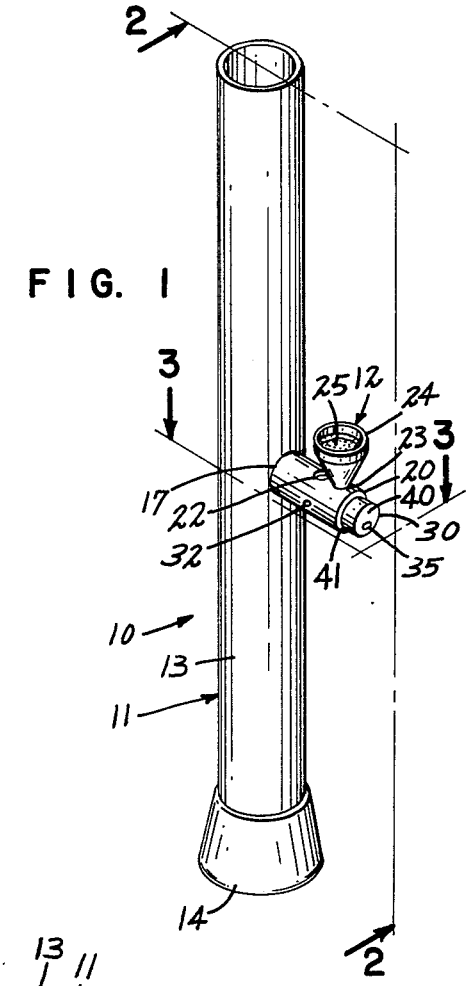
FIG. 1 is a general view of a water pipe according to my invention.

As shown in the drawing, my pipe 10 comprises an interconnected inhalation chamber 11 and bowl assembly 12. Chamber 11 includes a tube 13 of plastic or other suitable material closed at one end by a cap 14 secured to the tube, as by a threaded connection 15, and containing a selected liquid 16 to an intended level which may vary within rather wide limits, as will be discussed below. At a location above the highest intended level of liquid, tube 13 is provided with a bore 17 threaded to receive bowl assembly 12.

That assembly includes a hollow cylinder 20 threaded at one end to engage bore 17, and provided at the same end with an internal shoulder 21. Cylinder 20 is pierced by a medial radial opening 22 and a distal radial opening 23, the latter being near the end of the cylinder remote from shoulder 21. A hopper or tapered canister 24 is secured to cylinder 20 in the neighborhood of opening 23, to contain a supply of the herb 25 to be smoked.

Figure 3:
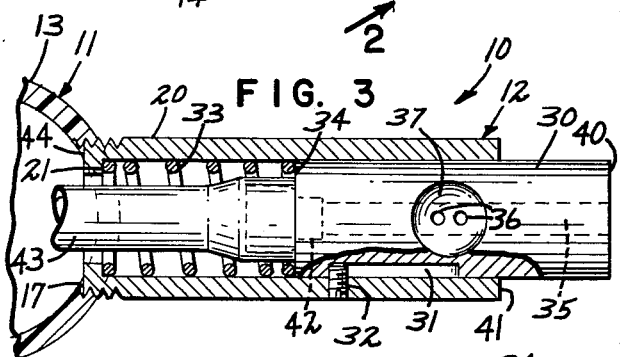
FIG. 3 is a fragmentary view along the line 3—3 of FIG. 1 to a still larger scale.
Figure 4:
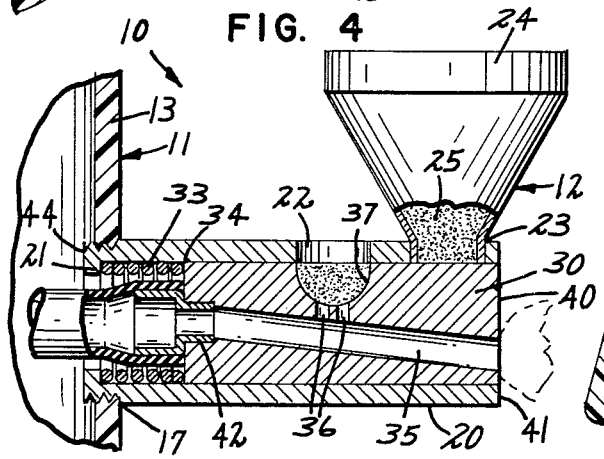
FIG. 4 is a fragmentary view generally like FIG. 2 but to a larger scale, showing a second state of the apparatus.
Figure 2:
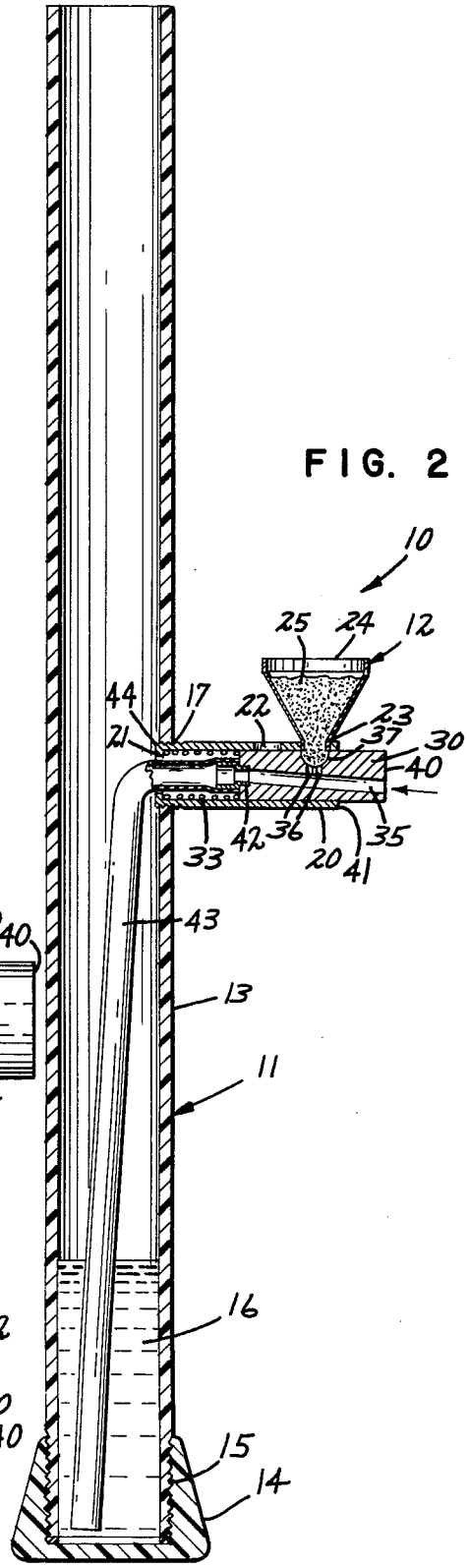
FIG. 2 is a longitudinal sectional view along the line 2—2 of FIG. 1 to a larger scale, showing the apparatus in a first state.

Also a part of bowl assembly 12 is a plunger 30 movable axially in cylinder 20, and having a blind groove 31 arranged to receive a pin 32 extending inwardly from cylinder 20. The ends of groove 31 limit the movement of plunger 30 in each direction, and the pin prevents it from rotating in cylinder 20. A coil spring 33 acts between shoulder 21 and the inner end 34 of plunger 30 to urge the latter outwardly, that is, to the right as seen in FIGS. 3 and 4. Plunger 30 has an elongated, generally axial bore 35 extending through it from end to end, which connects by one or more small perforations 36 with a radially disposed bowl cavity 37. In the inward position of plunger 30 (FIG. 4), cavity 37 is aligned with aperture 22, and in the outward position of plunger 30 (FIG. 2) cavity 37 is aligned with aperture 23. The apertures have the same shape and size as the rim of cavity 37, and the length of plunger 30 is such that when it is inwardly positioned, the outer end 40 is substantially flush with the outer end 41 of cylinder 20.

Bore 35 is connected inwardly, as by a fitting 42, with a flexible conduit 43 which passes through spring 33 and the inner end 44 of cylinder 20 and then turns downwardly within tube 13. Conduit member 43 is of sufficient flexibility and resilience to permit it to move with fitting 42 upon movement of the plunger in the cylinder.

In use, a desired liquid 16 is introduced to chamber 11 to the desired level: it will be appreciated that a larger quantity of liquid will have a greater cooling, cleaning, and flavoring effect, but will also be more difficult to draw smoke through. Hopper 24 is filled with the herb to be smoked in a finely powdered form, and bowl cavity 37 is filled as a result. The user places the open end of chamber 11 against his face in the area of his mouth, presses plunger 30 inwardly, in the direction of the arrow, with his fingertip over plunger 30, and applies a match at aperture 22, inhaling deeply as he does so. The pressure of his finger on plunger 30 closes the outer end of bore 35, so air and flame are drawn into the bowl assembly at aperture 22 and the herb is ignited and consumed in the bowl cavity, smoke from its combustion passing through conduit 43 and bubbling up through liquid 16 into chamber 11. The lower end of hopper 24 is sealed at this time by plunger 30. The amount of herb contained in cavity 37 is approximately that which can be consumed in one deep inhalation, any resultant ashes being drawn into the liquid with the smoke and trapped there.

The user may now release his pressure on plunger 30, which returns to its outward position, refilling bowl 37 against the next use. The outer end of aperture 35 now being uncovered, air may be drawn therethrough into conduit 43 and hence into chamber 11, replacing some of the smoke remaining there from the user's first inhalation. When the smoke in the chamber 11 is too dilute with air to be enjoyable, a repetition of the procedure described above renews the supply.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, with the principle of the invention, to the full extent indicated by the broad general meaning of the terms in which the appended claims are expressed.

What is claimed is:

1. A smoker's pipe comprising, in combination:

a bowl assembly including a hollow cylinder having an inwardly shouldered end, a medical radial lighting opening, and a distal radial filler opening;

a hopper mounted at said distal opening for supplying smoking material;

a plunger movable axially in said cylinder and having a generally axial bore, a radial bowl cavity of generally the same cross-sectional outline and size as said filler opening, and perforations connecting said bore with the bottom of said bowl cavity;

and spring and guide means acting between said shoulder and said plunger to urge the latter out of a first position, in which said bowl cavity is aligned with said medical opening, and a second position, in which said bowl cavity is aligned with said distal opening, said medial cavity is closed, and a first end of said plunger projects beyond the unshouldered end of said cylinder;

flexible conduit means secured to the inner end of said plunger, in communication with said generally axial bore, for moving said plunger within said cylinder;

an inhalation and liquid chamber comprising a vertical tube, means capping the lower end of said tube so that the latter may be filled with liquid to a desired level, and a lateral aperture located above said desired level;

and means securing said shouldered end of said cylinder in said lateral aperture with said flexible conduit extending toward the bottom of said chamber to terminate below said desired level.

2. A smoker's pipe comprising, in combination:

a bowl assembly including a hollow cylinder having an inwardly shouldered end, a medial radial lighting opening, and a distal radial filler opening;

a hopper mounted at said distal opening for supplying smoking material;

a plunger movable axially in said cylinder and having a generally axial bore, a radial bowl cavity of generally the same cross-sectional outline and size as said filler opening, and perforations connecting said bore with the bottom of said bowl cavity;

and spring and guide means acting between said shoulder and said plunger to urge the latter out of a first position, in which said bowl cavity is aligned with said medial opening, and a second position, in which said bowl cavity is aligned with said distal opening, said medial cavity is closed, and a first end of said plunger projects beyond the unshouldered end of said cylinder;

flexible conduit means secured to the inner end of said plunger, in communication with said generally axial bore, for moving said plunger within said cylinder and said spring means;

an inhalation and liquid chamber comprising a vertical tube, means capping the lower end of said tube so that the latter may be filled with liquid to a desired level, and a lateral aperture located above said desired level;

and means securing said shouldered end of said cylinder in said lateral aperture with said flexible conduit extending toward the bottom of said chamber to terminate below said desired level.

3. In a smoker's pipe, in combination:

a hollow cylinder having spaced radial openings;

a plunger having a radial bowl cavity and slidable in said cylinder;

conduit means for conducting smoke through said plunger from the bottom of said bowl cavity;

and a hopper for smoking material connected to one of said openings, so that said plunger may be displaced between a first position, in which said cavity is aligned with said one of said openings for filling from said hopper, and a second position, in which said cavity is aligned with the other of said openings for lighting said material.

4. A smoker's pipe, comprising, in combination:

an inhalation and liquid chamber;

a bowl assembly including a hollow cylinder opening into said chamber and having spaced radial openings, and a plunger slidable in said cylinder and having a bore axially therethrough and a radial bowl cavity connected at its bottom by a restricted passage with said bore between the ends thereof;

and means providing a passage for smoke and air to the bottom of said chamber from one end of said bore, for subsequent passage upward through liquid in said chamber, so that said plunger may be displaced between a first, resiliently maintained position aligned with one of said openings and a second position aligned with the other of said openings.

5. The method of smoking which comprises the steps of:

1. positioning a bowl cavity to be filled with smoking material at the top while affording access to the atmosphere at te bottom thereof;
2. displacing said bowl cavity from the filling position to a lighting position, and simultaneously cutting off said access to the atmosphere;
3. lighting the smoking material at the top of said cavity and burning it completely at a single long inhalation, while drawing the smoke and ashes of combustion through liquid into an inhalation chamber;
4. returning said bowl chamber to the filling position, to restore said access to the atmosphere;
5. and repeatedly making small inhalations from said chamber, while causing replacement air to pass to the chamber past the bottom of said cavity.

* * * * *

UNITED STATES PATENT AND TRADEMARK OFFICE

CERTIFICATE OF CORRECTION

PATENT NO. : 4,044,781

DATED : August 30, 1977

INVENTOR(S) : James E. Heggestuen

It is certified that error appears in the above-identified patent and that said Letters Patent are hereby corrected as shown below:

Column 3, line 28, "medical" should be --medial--.

Column 4, line 50, "te" should be --the--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*